US005649623A

United States Patent [19]

Kornblatt

[11] Patent Number: 5,649,623

[45] Date of Patent: Jul. 22, 1997

[54] LADDER MOUNTED TOOL BELT CARRIER

[76] Inventor: David A. Kornblatt, 1363 Breckford Ct., Westlake Village, Calif. 91361

[21] Appl. No.: 364,255

[22] Filed: Dec. 27, 1994

[51] Int. Cl.[6] ..... E06C 7/14

[52] U.S. Cl. ..... 206/373; 182/129; 220/735; 248/210

[58] Field of Search ..... 182/129; 206/372, 206/373; 220/17.1–17.3, 475, 480–482, 697, 729, 735, 736, 744, 751, 752, 754, 756, 769, 772, 23.83; 224/253; 229/117.29; 248/210, 211, 238

[56] References Cited

U.S. PATENT DOCUMENTS

| | | | |
|---|---|---|---|
| D. 315,797 | 3/1991 | Cagle | D25/68 |
| D. 317,206 | 5/1991 | Cagle | D25/68 |
| 2,865,546 | 12/1958 | Shull | 182/129 |
| 2,911,133 | 11/1959 | Ruggieri | 182/124 |
| 4,356,854 | 11/1982 | McGee | 150/12 |
| 4,383,669 | 5/1983 | Rasler | 248/238 |
| 4,428,458 | 1/1984 | Fiore et al. | 182/129 |
| 4,653,713 | 3/1987 | Hamilton | 248/238 |
| 4,679,242 | 7/1987 | Brockhaus | 224/253 |
| 4,706,918 | 11/1987 | Wilson | 248/210 |
| 4,765,472 | 8/1988 | Dent | 206/373 |
| 4,773,535 | 9/1988 | Cook | 206/373 |
| 4,850,502 | 7/1989 | Davis | 220/759 |
| 4,874,147 | 10/1989 | Ory et al. | 182/129 |
| 4,953,765 | 9/1990 | Little et al. | 224/151 |
| 4,993,551 | 2/1991 | Lindsay | 206/373 |
| 5,052,581 | 10/1991 | Christ et al. | 248/211 |
| 5,205,448 | 4/1993 | Kester et al. | 224/253 |
| 5,259,093 | 11/1993 | D'Annunzio | 224/253 |
| 5,333,823 | 8/1994 | Joseph | 182/129 |

FOREIGN PATENT DOCUMENTS

| | | | |
|---|---|---|---|
| 250232 | 5/1948 | Switzerland | 224/243 |

*Primary Examiner*—Jimmy G. Foster
*Attorney, Agent, or Firm*—Loeb & Loeb LLP

[57] ABSTRACT

An improved apparatus and method for holding articles on a ladder, operable with a combination of a tool belt, a tool box, and/or an apron. In one combination that uses all of these items, the apron has belt loops. The apron attaches to the sidewall of the tool box. The belt loops secure the tool belt. And the tool box with the apron and the tool belt attached is situated on the top step of the ladder. To stabilize the tool box on the top step, the apron has an edge overhang, which extends over at least part of the sidewall of the top step. For further stabilization, the belt loops also extend over at least part of the sidewall of the top step, thereby allowing the tightening of the tool belt around the sidewall of the top step. Additionally the tool box is stabilized on the step ladder by straps attached to either the tool box or to the apron itself. The straps extend underneath the top step of the step ladder.

32 Claims, 3 Drawing Sheets

LADDER MOUNTED TOOL BELT CARRIER

BACKGROUND OF THE INVENTION

1. Field of the Invention

This invention relates generally to apparatuses and methods for locating tools on pedestals and, in particular embodiments, to a novel apparatus and method for conveniently locating a tool belt with tools on a top step of a ladder or stepladder.

2. Description of Related Art

Craftspersons (professionals or amateurs) are often faced with the task of working with tools or other items, while on or around ladders. In some situations, this involves careful balancing, while holding tools or items and maneuvering up and down the ladders. In other situations, craftspersons wear or carry tool belts, while maneuvering up and down the ladder. Tool belts can get snagged in the steps of the ladder. Aside from the inconvenience this can cause, there is also the danger that craftspersons might fall off or knock over the ladder as a result of losing their balances or snagging their tool belts.

A wide variety of devices have the purpose of making it easier for craftspersons to use their tools around ladders. Some devices use bags that fit over the top step of a ladder (see U.S. Pat. No. Des. 317,206). Such bags have pockets in them for inserting various tools. Some devices include a box-type enclosure on top of the bag for placing tools (see U.S. Pat. No. 4,356,854).

Another example of a traditional solution to handling tools around ladders is to have a box attached to one side of the top portion of the ladder (see U.S. Pat. No. 2,911,133). Such a box attaches to the ladder with specially designed holding bars.

Finally, one device provides the capability of securing a tool box on the top step of a ladder by the use of a mounting clip to fit into a nonstandard opening of a modified tool box (see U.S. Pat. No. 4,653,713).

However, none of the above described devices has succeeded in accommodating craftspersons who would like to keep their tool belts and/or tool boxes and other items conveniently near them, while they are working on ladders.

SUMMARY OF THE DISCLOSURE

In accordance with preferred embodiments of the present invention, an apparatus and method is capable of supporting a belt around a pedestal (a pedestal is a structure for providing support, e.g. the top step of a ladder, or even the top of a barstool).

According to one embodiment of the invention, an apparatus for holding articles on a pedestal is operable with a belt, such as a tool belt. The apparatus comprises a container having a bottom surface and an outer peripheral surface. The bottom surface of the container is configured for placement on an upper surface of the pedestal. One or more belt loops are attached to the outer peripheral surface of the container for supporting a belt adjacent the outer peripheral surface of the container.

In another embodiment of the invention, the dimensions of the outer peripheral wall of the container are substantially similar to the dimensions of the upper surface of the pedestal. In addition, at least one belt loop extends below the bottom surface of the container to overlap a top sidewall of the pedestal upon the bottom surface of the container being placed on the upper surface of the pedestal. In this arrangement, a belt supported by the belt loop overlaps the upper sidewall of the pedestal and can be tightened around the upper sidewall to help secure the container to the upper surface of the pedestal.

Another embodiment of the invention, which is also operable with a belt and a pedestal, comprises an apron covering the container. A belt loop attaches to the outside surface of the apron for supporting a belt adjacent to the outside surface of the apron. Preferably, the apron has an edge overhang that extends below the bottom surface of the container to overlap the top sidewall of the pedestal upon the bottom surface of the container being placed on the upper surface of the pedestal. This edge overhang stabilizes the container on the pedestal.

In another variation of this embodiment, at least one belt loop extends below the bottom surface of the container to overlap the top sidewall of the pedestal upon the bottom surface of the container being placed on the upper surface of the pedestal. This also stabilizes the container on the pedestal.

In any of the above discussed embodiments of the invention, the belt loop can have a first end which is permanently attached to the apron, and a second end, which is attachable to the container by a releasable attaching means.

Also, in any of the above discussed embodiments of the invention, one or more straps are preferably attached to the apron or the container. Such straps can extend underneath the upper surface of the pedestal for strapping the container to the pedestal.

The above discussed and many other features and attendant advantages of the present invention will become better understood by reference to the following detailed description, when considered in conjunction with the accompanying drawings.

DETAILED DESCRIPTION OF THE PREFERRED EMBODIMENTS

The following detailed description is of the best presently contemplated mode of carrying out the invention. This description is not to be taken in a limiting sense, but is made merely for the purpose of illustrating general principles of embodiments of the invention. The scope of the invention is best defined by the appended claims.

In the figures discussed below, the same or equivalent items shown in the figures are identified by the same reference numbers.

Figure 1:
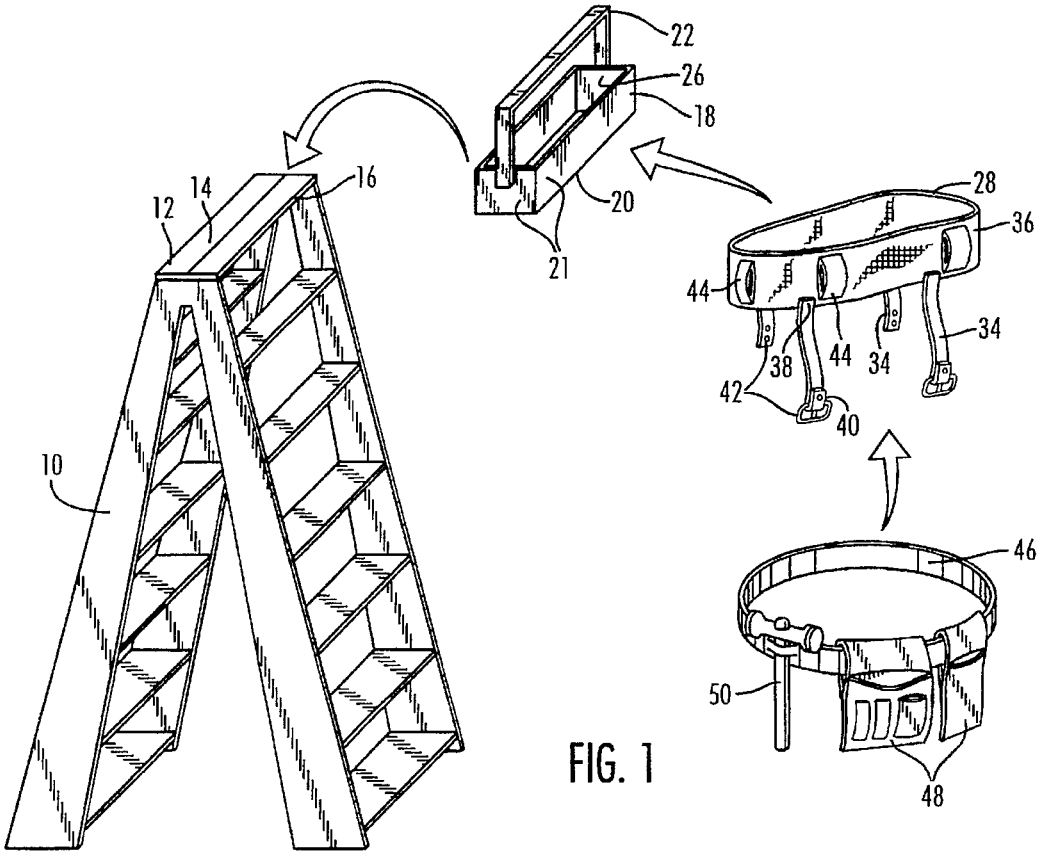
FIG. 1 is an exploded, perspective view showing the individual parts of a tool belt carrier (an apron and a tool box) in conjunction with a tool belt and a ladder, in accordance with an embodiment of the present invention.
Figure 2:
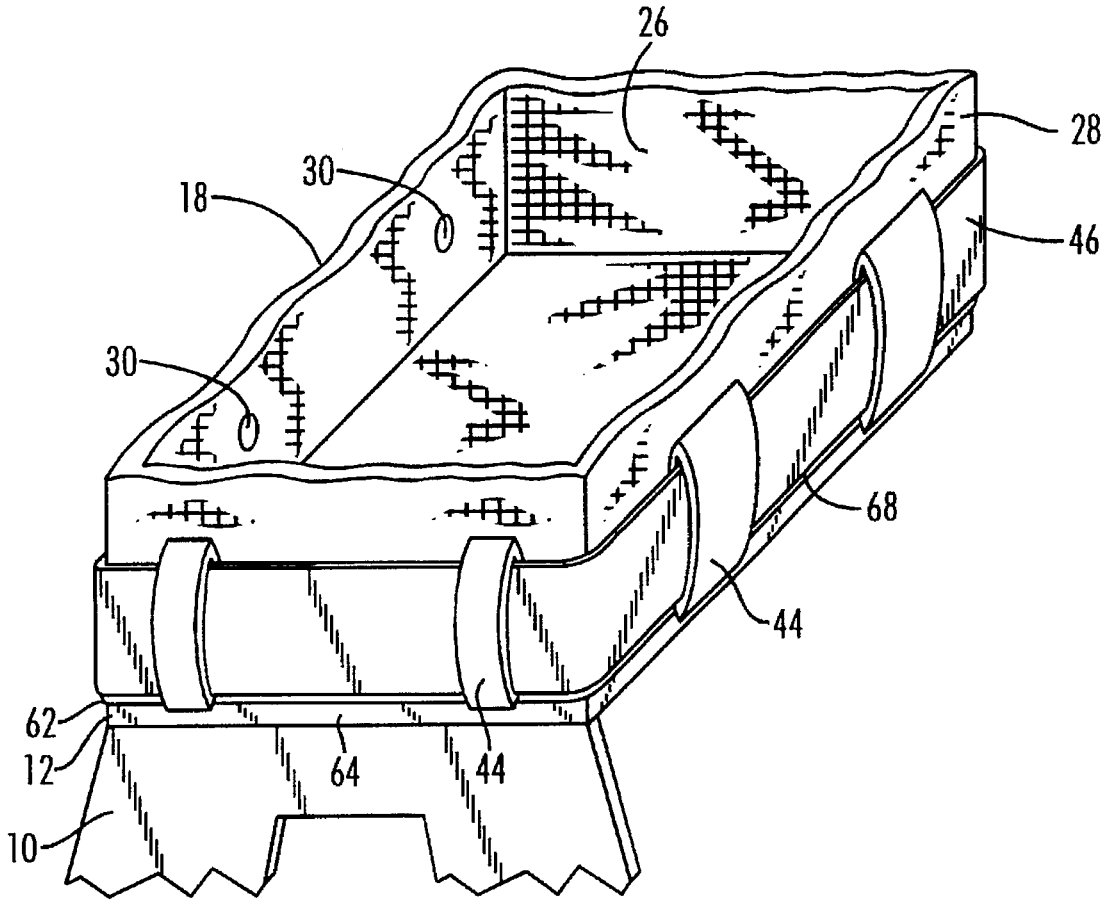
FIG. 2 is a perspective view of an assembled tool belt carrier as shown in FIG. 1.

Illustrated in FIGS. 1 & 2 is a ladder mounted tool belt carrier according to a preferred embodiment of the invention, as used in conjunction with a standard ladder 10. FIG. 1 provides an overview of how the preferred embodiment cooperates with a ladder 10 and a tool belt 46.

The ladder 10 has a top step 12, defining an upper surface 14, as well as a peripheral edge 16. A tool box 18 having a bottom surface 20, roughly the size of the upper surface 14 of a standard top step 12, is placed on the top step 12 of the ladder 10. Standard ladders 10 typically have top steps 12 with upper surfaces 14 in the range of 4–6 inches by 12–14 inches. The tool box 18 has a handle 22, an outer peripheral surface 21, and an inside surface 26.

An apron 28 (made of, for example, canvas, plastic, nylon, leather, a combination thereof, or other material suitable for supporting an attached tool belt 46 with accessories, as discussed below) fits around the outer peripheral surface 21 of the tool box 18. The apron 28 preferably is riveted to the outer peripheral surface 21 of the tool box 18. Alternatively, the apron 28 could be attached to the tool box 18 with any suitable securing means including, but not limited to screws, bolts, adhesives, stitching, snaps, or the like.

The apron 28 has at least one belt loop and, preferably, multiple belt loops 44 located adjacent to the outside surface 36 of the apron 28. These belt loops 44 are dimensioned to receive a belt (preferably a tool belt 46) strapped therethrough. Tool belt 46 may be a standard tool belt provided with pouches 48 and other means for holding tools, e.g. a hammer 50 and/or paraphernalia, such as screws, nails, etc. In further embodiments, clips, hooks or other belt supporting structures may be used as an alternative to belt loops. However, for simplifying the present disclosure and claims, the term "belt loops" will be understood to refer to any suitable means for supporting a belt.

FIG. 2 shows an assembled tool belt carrier as shown in FIG. 1. FIG. 2 illustrates the tool box 18 with an apron 28 riveted with rivets 30 (or attached by other means, as discussed below) to the outer peripheral surface 21 of the tool box 18. The tool box 18 is situated on the top step 12 of the ladder 10. As in FIG. 1, the apron 28 has belt loops 44 for supporting the tool belt 46.

The apron 28 has an edge overhang 62. The edge overhang 62 provides additional support to the tool box 18. The edge overhang 62 extends over at least part of the step sidewall 64 (only the uncovered portion of the step sidewall 64 is shown in FIG. 2) on all four sides of the rectangular top step 12. As a result, the edge overhang 62 of the apron 28 inhibits the tool box 18 from sliding off the top step 12. It is recommended that the user of the ladder be aware of the total weight limit of the ladder (usually specified by the manufacturer of the ladder) and not exceed the weight limit with the additional weight of the tool box, tool belt and any tools or items held by the same.

The belt loops 44, shown in FIG. 2, extend beyond the peripheral edge 16 (not shown in FIG. 2, because it is covered by apron 28, but shown in FIG. 1). With this arrangement, the tool belt 46, when secured by the belt loops 44, has a bottom edge 68 that extends beyond the peripheral edge 16. The rigidity of the tool belt 46 and the ability of the tool belt 46 to be tightened around the step sidewall 64 helps secure the apron 28 and the tool box 18 and the tool belt 46 to the ladder 10. Therefore, the tool belt bottom 68 further inhibits the tool box 18 from sliding off the top step 12 of the ladder 10. As a result, the likelihood of someone accidentally pushing the tool box 18 off the ladder 10 is reduced.

Furthermore, embodiments of the invention make it possible for the craftsperson to conveniently locate a tool belt 46, by securing the tool belt 46 with the belt loops 44 of the apron 28. To properly secure the tool belt 46 with the belt loops 44, the tool belt 46 is inserted through the belt loops 44 and secured to the tool belt 46. Additionally, if desired, any tools and pouches 48 can be attached to the tool belt 46.

Figure 3:
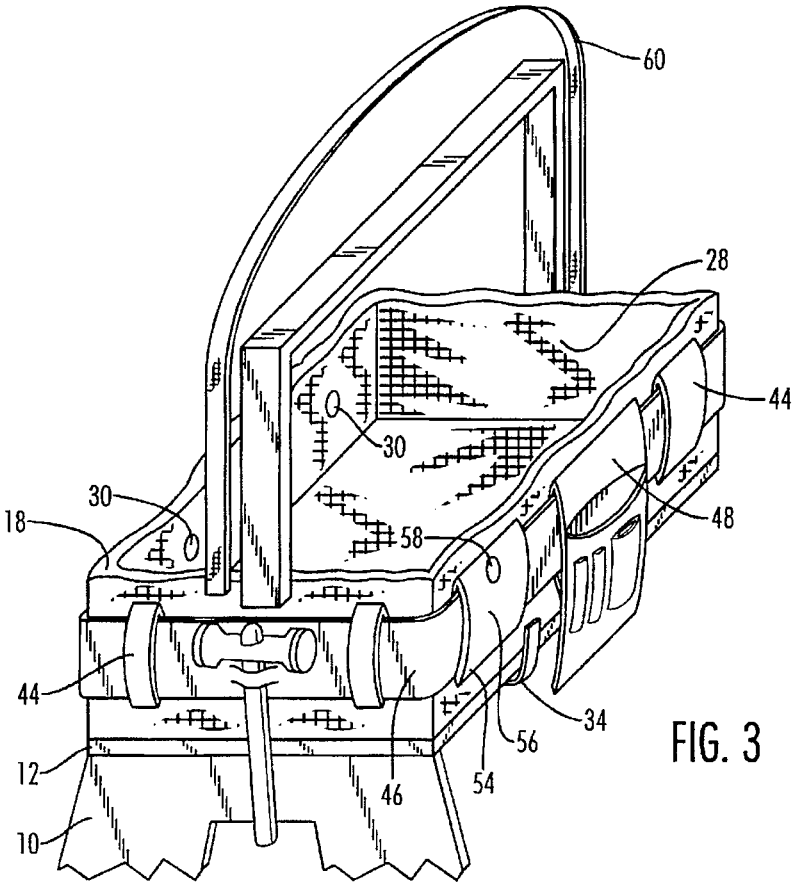
FIG. 3 is a perspective view showing a tool belt carrier, in accordance with another embodiment of the invention.

Consequently, a craftsperson is able to conveniently secure a tool belt 46 and a tool box 18 to the top step 12 of a ladder 10 and to freely move on the ladder 10 without a heavy tool belt 46 or a tool box 18 hindering the craftsperson's movement. Moreover, the tools on the tool belt 46 are conveniently located on the top step 12 of the ladder 10 and readily accessible to anybody working on or near the ladder 10. Other embodiments, one of which is illustrated in FIG. 3, do not include an apron edge overhang 62 and/or belt loops 44 which extend beyond the top step peripheral edge 16.

To further reduce the likelihood of the tool box 18 being accidentally pushed off the ladder 10, the apron 28 preferably has straps 34 for extending under the top step 12 and strapping the tool box 18 to the top step 12. In the preferred embodiment shown in FIG. 1, there are four straps 34 attached in pairs to the outside apron surface 36, with two of the four straps 34 attached on the opposite side of the apron 28 with respect to the other two straps 34.

Each strap 34 has a first strap end 38 and a second strap end 40. The first strap ends 38 are attached to the apron 28. The straps 34 have connectors 42 (such as snaps, buckle connectors, hook and loop fastening material, for example, as sold under the trademark "Velcro," or other suitable fasteners) on their second strap ends 40, such that the connector 42 ends of straps 34 on opposite sides of the apron 28 mate underneath the top step 12 of the ladder 10 to strap the tool box 18 to the top step 12 of the ladder 10.

Alternatively, the straps 34 can be without connectors 42. In that case, oppositely located second strap ends 40 can be tied together underneath the top step 12 to secure the tool box 18 to the top step 12. Of course, with or without connectors 42, a single pair of straps 34 would be sufficient to strap down the tool box 18. Another alternative, is to have one or more straps 34 attached at a first strap end 38 to one side of the apron 28 and releasably secured at a second strap end 40 to the apron 28 or to the tool box 18.

In another embodiment of the present invention, as illustrated in FIG. 3, the apron 28 covers the inside surface 26 of the tool box 18. The apron 28 is shaped such that it fits snugly against the inside surface 26 of the tool box 18.

To maintain the apron 28 in place, the apron 28 is rivetted with rivets 30 to the inside surface 26 of the tool box 18. Of course, the apron 28 could be attached to the tool box 18 by some other means, as, for example, screws, nails, adhesives, or other coupling means suitable to keep the apron 28 attached to the tool box 18.

In another embodiment of the invention, the belt loops 44 may be permanently affixed to the apron 28 or may be attached to the apron 28 by means which allow one or both loop ends (54 and/or 56) to be selectively disconnected from the apron 28. Such means may include, but are not limited to snaps, buttons, clips, hook and loop fastening material, or the like. Thus, the craftsperson could, for example, snap a tool belt 46 into place around the tool box 18 without removing from the tool belt 46 any of the pouches 48 or tools that would not fit through the belt loops 44.

Preferably, the belt loop lower ends 54 are permanently attached to the apron 28, whereas the belt loop upper ends 56 are connected by disconnectable means. This reduces the chance that the disconnectable ends of the belt loops 44 will be inadvertently disconnected due to the weight of the tool belt 46 bearing down directly on the belt loop snap 58 (shown in FIG. 3).

To further enhance the convenience and safety, another preferred embodiment of the invention is provided with a carrier strap 60 (as illustrated in FIG. 3) attached to the sides of the tool box 18 or to the apron 28. The carrier strap 60 can be used as a shoulder strap to enable a craftsperson to support the tool box 18 from his or her shoulder.

Figure 4:
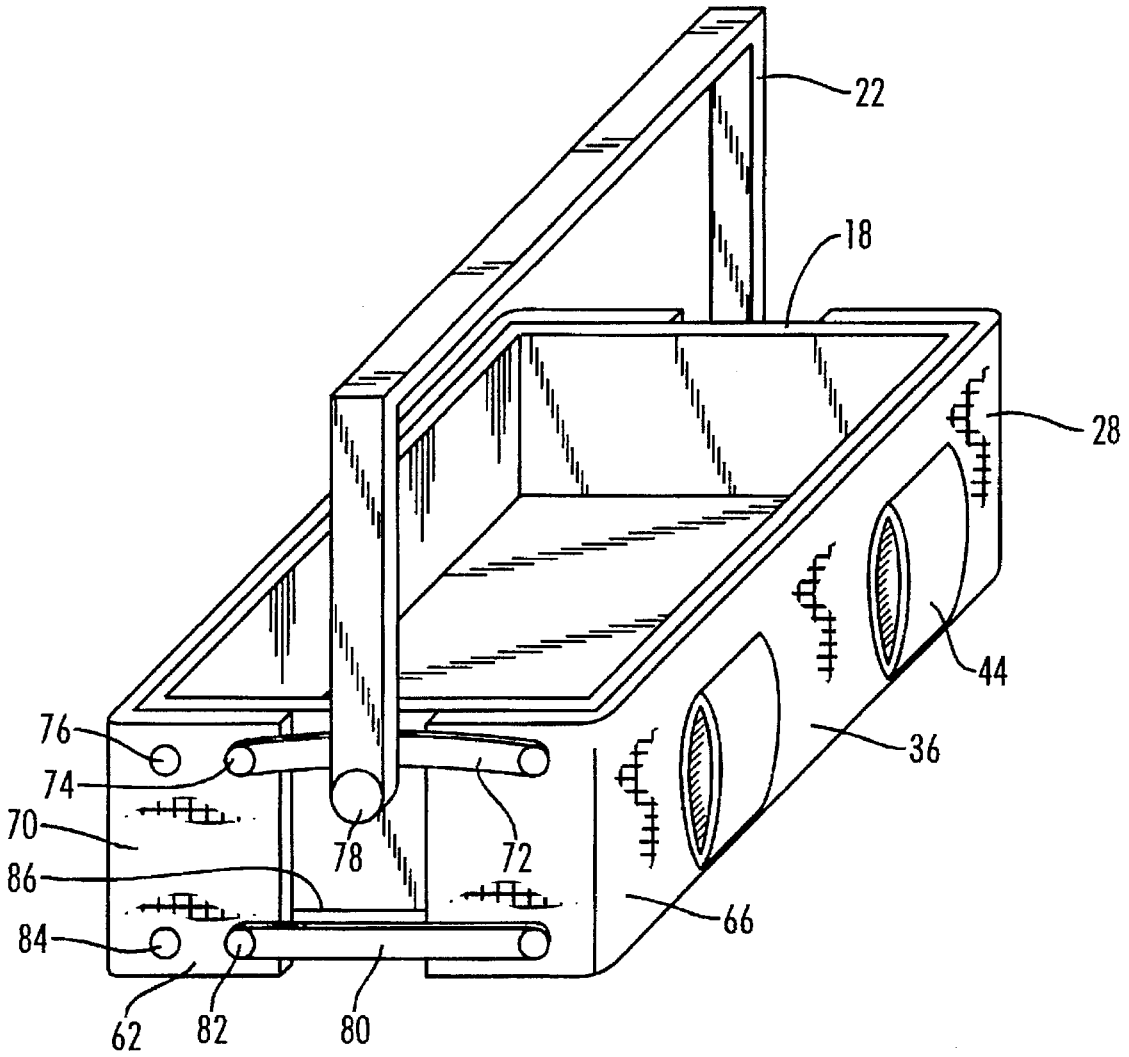
FIG. 4 is a perspective view showing a tool belt carrier comprising an apron adaptable to tool boxes of various sizes, in accordance with another embodiment of the invention.

Finally, FIG. 4 illustrates a further embodiment of the invention having a feature that allows the apron 28 to be adaptable to tool boxes 18 of various sizes. FIG. 4 shows an apron 28 made up of a first apron portion 66 and a second apron portion 70. The first apron portion 66 and the second apron portion 70 have belt loops 44 attached to them. Additionally, a first handle strap 72 and a second handle strap (not shown because of the perspective nature of the view shown in FIG. 4) attach to each end of the first apron portion 66.

Each end of the second apron portion 70 has connectors, such as strings, snaps, buttons, clips, hook and loop fastening material, a combination thereof, or the like. A first 74 and a second 76 connectors attached at one end of the second apron portion 70 are illustrated in FIG. 4. And at the other end of the second apron portion 70 there are attached a third (not shown because of the perspective nature of the view shown in FIG. 4), and a fourth (not shown because of the perspective nature of the view shown in FIG. 4) connectors.

The first 72 and second (not shown) handle straps are pulled over a first 78 and second (not shown) handle hinges, respectively, and connected to the first 74 or second 76 connector, and to the third or fourth connector (not shown), respectively, depending on the size of the tool box 18. The first 72 and second (not shown) handle straps prevent (in addition to a tool belt 46 secured with the belt loops 44 and tightened around the tool box 18) the apron 28 from sliding off the tool box 18 under the weight of the tool belt 46. And the availability of more than one connector at each end of the second apron portion 70 enables the craftsperson to adjust the first 72 and second (not shown) handle straps in accordance with the size of the tool box 18.

To further tighten the apron 28 around the tool box 18, a first lower strap 80 and a second lower strap (not shown because of the perspective nature of the view shown in FIG. 4) attach to each end of the first apron portion 66. Similarly to the first 72 and second (not shown) handle straps, the first 80 and second (not shown) lower straps are located on opposite sides of the apron 28.

Connectors (such as strings, snaps, buttons, clips, hook and loop fastening material, a combination thereof, or the like) are attached to each end of the second apron portion 70 for fastening the first 80 and second (not shown) lower straps to the second apron portion 70. The first lower strap 80 connects to a fifth 82 or to a sixth 84 connector, depending on the size and shape of the tool box 18. The second lower strap (not shown) connects to a seventh (not shown because of the perspective nature of the view shown in FIG. 4) or eighth connector (not shown because of the perspective nature of the view shown in FIG. 4), also depending on the size and shape of the tool box 18.

One advantage of the embodiment of the invention illustrated in FIG. 4 is that the apron 28 may be adapted to a variety of tool boxes 18 of different sizes. This is possible because the two apron portions, 66 and 70, can be spaced with respect to each other at variable distances. That variable spacing is accomplished by fastening the handle straps 72 and the lower straps 80 to the appropriate connectors.

In another embodiment of the invention, the apron 28 has only one portion (as opposed to a first 66 and a second 70). However that portion is sufficiently long to wrap around the tool box 18, as both portions together do in FIG. 4. A first handle strap 72 is secured across the first handle hinge 78 for supporting the apron 28 from and tightening the apron 28 around the tool box 18. In a variation of that embodiment, the apron 28 has a second handle strap and an associated connecting means (as discussed above with respect to the two-portion apron 28) attached to the middle region of the apron's outside surface 36 for securing the apron 28 to the second handle hinge (not shown).

The apron 28 in FIG. 4 can be equipped with straps 34, as in FIG. 1, for additional means of securing the tool box 18 to the pedestal, in particular to a top step 12 of a ladder 10. Moreover, by draping beyond the bottom edge 86 of the tool box 18 shown in FIG. 4, the apron 28 provides an edge overhang 62. As in FIGS. 1 & 2, that edge overhang 62, functions as an additional means of securing the tool box 18 to the top step 12 of the ladder 10.

Another embodiment of the invention is an apron 28 having any of the forms discussed above, with one or more belt loops 44 for securing a belt, preferably a tool belt 46, but without a tool box 18. This embodiment fits directly over or around a pedestal, such as a top step 12. A further embodiment has an apron 28, but without any belt loops. Nevertheless, a belt is used to tighten the apron 28 around the pedestal or around the tool box 18. In yet a further embodiment, belt loops, hooks or other belt supporting structures, are coupled directly to the pedestal (such as to the peripheral side of the top step of a ladder) to support a tool belt directly to the ladder.

In further embodiments of the invention, a tool box 18 with at least one belt loop (or other suitable belt supporting structure, including, but not limited to hooks, clips or the like) attached directly to the outer surface of the box for securing a tool belt 46, but without an apron 28.

The belt loop(s) or other belt supporting structure extend below the top edge of the pedestal or are otherwise arranged such that the belt extends below the top edge of the pedestal. This allows the belt to extend around the peripheral side surface of the top step of the pedestal so as to be tightened around the peripheral side surface. In addition, straps (such as straps 34 discussed above) may be attached directly to the outer surface of the box 18, without an apron 28. The straps 34, belt loop(s) or other belt supporting structure may be attached to the box 18 by any suitable securing means including, but not limited to rivets, screws, bolts, adhesives or the like.

A further embodiment of the invention would include not only a tool box 18 and an apron 28, but also a pedestal on which are situated the tool box 18 with the apron 28 attached to the tool box 18.

Having thus described exemplary embodiments of the present invention, it should be understood by those skilled in the art that the above disclosures are exemplary only and that various other alternatives, adaptations and modifications may be made within the scope of the present invention.

The presently disclosed embodiments are to be considered in all respects as illustrative and not restrictive. The scope of the invention being indicated by the appended claims, rather than the foregoing description, and all changes which come within the meaning and range of equivalency of the claims are, therefore, intended to be embraced therein.

What is claimed is:

1. Apparatus for holding a belt and other articles on a pedestal, the pedestal being the type having an upper surface and a top sidewall extending downward and below relative to the upper surface, the apparatus comprising:

a container for placement on the pedestal, the container having at least two opposing sides, an open interior for holding articles and a bottom surface configured to be disposed on the upper surface of the pedestal upon the container being placed on the pedestal; and a plurality of belt retaining members including at least two belt retaining members secured to each of at least two of said opposing sides of the container and extending at least partially below the bottom surface of the container and at least partially below the upper surface of the pedestal upon the bottom surface of the container being disposed on the upper surface of the pedestal;

wherein the at least two belt retaining members secured to each opposing side are configured to hold the belt around the container, upon the container being placed on the pedestal and while the belt overlaps and extends around the top sidewall of the pedestal.

2. Apparatus as recited in claim 1, wherein the container has an outer peripheral wall having dimensions substantially similar to the dimensions of the top sidewall of the pedestal.

3. Apparatus as recited in claim 1, wherein each belt retaining member comprises a belt loop having a first end which is attached to the container, and a second end which is attachable to the container by a releasable attaching means.

4. Apparatus as recited in claim 3, wherein the belt loop has a first and a second end, both of which are attachable to the container by a releasable attaching means.

5. Apparatus as recited in claim 1, wherein the pedestal upper surface is substantially flat, and wherein the container bottom surface is substantially flat.

6. Apparatus as recited in claim 1, further comprising a first and a second straps located opposite each other on the outer peripheral surface of the container, each strap having a first and a second strap ends, each first strap end being attached to the container and each second strap end being connectable to the second strap end of the other strap, wherein the straps are extendable underneath the upper surface of the pedestal for strapping the container to the pedestal.

7. Apparatus as recited in claim 6, wherein the second ends of the straps have hook and loop fastening material attached to them, so that the second strap ends located opposite each other mate for strapping the container to the pedestal.

8. Apparatus as recited in claim 1, further comprising a strap located on the outer peripheral surface of the container, having a first and a second strap ends, the first strap end being attached to the container and the second strap end being releasably connectable to the outer peripheral surface of the container, wherein the strap is extendable underneath the upper surface of the pedestal for strapping the container to the pedestal.

9. Apparatus as recited in claim 1, further comprising a handle attached to the container.

10. Apparatus as recited in claim 1, further comprising a carrier strap attached to the container.

11. Apparatus as recited in claim 1, wherein each belt retaining member comprises a belt loop.

12. Apparatus as recited in claim 1, wherein each belt retaining member comprises a hook.

13. Apparatus as recited in claim 1, wherein the container has an outer peripheral surface and wherein the apparatus further comprising an apron secured to the container, adjacent the outer peripheral surface of the container, wherein the at least one belt retaining member is secured to the apron.

14. Apparatus as recited in claim 13, wherein the apron has first and second apron portions, each apron portion having an outside surface, each apron portion having first and second ends, such that the first apron end of the first apron portion is adjacent the second apron end of the second apron portion, and such that the second apron end of the first apron portion is adjacent the first apron end of the second apron portion.

15. Apparatus as recited in claim 14, further comprising:

a first and a second handle strap attaching means attached to the first and second apron ends, respectively, of the second apron portion; and a first and a second handle straps each having a first and a second handle strap ends, the first handle strap end of the first handle strap being attached to the first apron end of the first apron portion, the first handle strap end of the second handle strap being attached to the second apron end of the first apron portion, the second handle strap end of the first handle strap being capable of attaching to the second handle strap attaching means, and the second handle strap end of the second handle strap being capable of attaching to the first handle strap attaching means.

16. Apparatus as recited in claim 13, wherein the dimensions of the outer peripheral wall of the container are substantially similar to the dimensions of the upper surface of the pedestal, and wherein the apron has an edge overhang that extends below the bottom surface of the container to overlap the top sidewall of the pedestal upon the bottom surface of the container being placed on the upper surface of the pedestal.

17. Apparatus as recited in claim 13, wherein the dimensions of the outer peripheral wall of the container are substantially similar to the dimensions of the upper surface of the pedestal, and wherein at least one belt retaining member extends below the bottom surface of the container to overlap the top sidewall of the pedestal upon the bottom surface of the container being placed on the upper surface of the pedestal.

18. An assembly for holding articles on a pedestal, the pedestal being the type having an upper surface and a top sidewall extending downward and below relative to the upper surface, the assembly comprising the combination of:

a container for placement on the pedestal, the container having at least two opposing sides, an open interior for holding articles and a bottom surface configured to be disposed on the upper surface of the pedestal upon the container being placed on the pedestal;

at least two belt retaining members secured to each of at least two of said opposing sides of the container and extending at least partially below the bottom surface of the container and at least partially below the upper surface of the pedestal upon the bottom surface of the container being disposed on the upper surface of the pedestal; and a belt configured to be retained by the belt retaining members.

19. An assembly as recited in claim 18, wherein the container has an outer peripheral wall having dimensions substantially similar to the dimensions of the top sidewall of the pedestal.

20. Apparatus as recited in claim 18, wherein the belt retaining member has a first end which is attached to the container, and wherein the belt retaining member has a second end, which is attachable to the container by a releasable attaching means.

21. An assembly as recited in claim 18, wherein the belt retaining member has a first and a second end, both of which are attachable to the container by a releasable attaching means.

22. An assembly as recited in claim 18, wherein the pedestal upper surface is substantially flat, and wherein the container bottom surface is substantially flat.

23. An assembly as recited in claim 18, further comprising a first and a second straps located opposite each other on the outer peripheral surface of the container, each strap having a first and a second strap ends, each first strap end being attached to the container and each second strap end being connectable to the second strap end of the other strap, wherein the straps are extendable underneath the upper surface of the pedestal for strapping the container to the pedestal.

24. Apparatus as recited in claim 6, wherein the second ends of the straps have hook and loop fastening material attached to them, so that the second strap ends located opposite each other mate for strapping the container to the pedestal.

25. An assembly as recited in claim 18, further comprising a strap located on the outer peripheral surface of the container, having a first and a second strap ends, the first strap end being attached to the container and the second strap end being releasably connectable to the outer peripheral surface of the container, wherein the strap is extendable underneath the upper surface of the pedestal for strapping the container to the pedestal.

26. An assembly as recited in claim 18, further comprising a handle attached to the container.

27. An assembly as recited in claim 18, further comprising a carrier strap attached to the container.

28. An assembly as recited in claim 18, wherein the belt includes means for holding tools along the length of the belt.

29. An assembly as recited in claim 18, wherein the at least one belt retaining member comprises a plurality of belt loops.

30. An assembly as recited in claim 18, wherein said container has at least two opposing sides and wherein said at least one belt retaining member includes at least one belt retaining member secured to each of at least two of said opposing sides of the container.

31. A storage and support assembly for holding and supporting articles, the assembly comprising:

a pedestal having an upper surface and a top sidewall extending downward and below relative to the upper surface;

a container disposed on the pedestal, the container having at least two opposing sides, an open interior for holding articles and a bottom surface;

a belt; and a plurality of belt retaining members including at least one belt retaining member secured to each of at least two of said opposing sides of the container and adapted to extend at least partially below the bottom surface of the container and at least partially below the upper surface of the pedestal;

wherein the at least one belt retaining member secured to each opposing side is configured to hold the belt around the container while the belt overlaps and extends around the top sidewall of the pedestal.

32. An assembly as recited in claim 31, wherein said at least one belt retaining member secured to each of at least two of said opposing sides of the container comprises at least two belt retaining members secured to each of at least two of said opposing container sides.

* * * * *